US006634767B2

(12) United States Patent
Huang

(10) Patent No.: US 6,634,767 B2
(45) Date of Patent: Oct. 21, 2003

(54) STICKING-POSITIONED FIREWORK LIGHT

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 10/096,285

(22) Filed: Mar. 13, 2002

(65) Prior Publication Data

US 2003/0174515 A1 Sep. 18, 2003

(51) Int. Cl.[7] ..... F21S 13/14

(52) U.S. Cl. ..... 362/252; 362/236; 362/123; 362/806

(58) Field of Search ..... 362/171, 236, 362/250, 252, 555, 121, 122, 123, 124, 102, 431, 806, 249

(56) References Cited

U.S. PATENT DOCUMENTS 4,924,358 A * 5/1990 Von Heck ..... 362/555
6,089,727 A * 7/2000 Wu ..... 362/102
6,260,989 B1 * 7/2001 Ingraselino ..... 362/383
6,488,391 B1 * 12/2002 Gary et al. ..... 362/249
2002/0097577 A1 * 7/2002 Huang ..... 362/240

* cited by examiner

*Primary Examiner*—Sandra O'Shea
*Assistant Examiner*—Hargobind S. Sawhney
(74) *Attorney, Agent, or Firm*—Troxell Law Office PLLC

(57) ABSTRACT

A sticking-positioned firework light comprising: on the top of which a base seat makes positioning of a plurality of radiation lamp pipes; a main lamp pipe extends downwardly from the center of the base seat; the radiation lamp pipes and the main lamp pipe is made of soft elastomer, and lamp strings are placed in the radiation lamp pipes and the main lamp, the conductors of the lamp strings are connected to a light control device; the radiation lamp pipes are inserted into a plurality of corresponding positioning means provided on the top of the base seat, the conductors are extended each for an ample length when normally being inserted in the positioning means to be contracted in the base seat. The entire firework light can be mounted by sticking in a field to provide a viewing effect of a firework; the firework light can be packed up in a packing box of smaller volume.

5 Claims, 5 Drawing Sheets

STICKING-POSITIONED FIREWORK LIGHT

BACKGROUND OF THE INVENTION

1. Field of the Invention

The present invention is related to a sticking-positioned firework light, and especially to a firework light made from a plurality of lamp strings of low cost and with a viewing effect of a firework after positioning by sticking as if the firework were ignited to explode, it is suitable especially for packing up in a small package.

2. Description of the Prior Art

Earlier decorative lamps mostly have a lot of light beads on a single conductor, by electric connection of the conductor, the light beads illuminate or flash to obtain a decoration effect, the decoration effect of such conventional lamp strings is still monolithic and not vivid enough though. Decorative lamps used nowadays give the function of creating various illuminating letters or patterns through electronically controlled netting devices; decorative net lights or netting lamps used for this were disclosed in the U.S. Pat. Nos. 5,645,342 and 5,951,146. However, such decorative lamps normally are larger by size and cost higher.

And among lamp designing in the present days generally, for the purpose of more embodying, injection molding is used to make imitated figures (such as Santa Claus) or imitated articles (such as a meteor). And then the figures or articles are decorated with lamp beads individually, they display the images of Santa Claus or the meteor when are electrically turned on, such as is the case of the U.S. Pat. No. 5,712,770; however, such decorating things are fixed per se, the decoration effect of them is stationary, they are inferior in attraction.

A U.S. patent application Ser. No. 09/897,926 concerning a structure of firework light of a larger type which can generate an effect of lightened firework with a flashing function as the firework lightened in a ceremony has been filed by the applicant of the present application. The improved firework light or any of the conventional firework lights of such kind is a firework light of the larger type, it has a height of between 1.5 m to 3 m, while the stretching ranges of the radial rods of such a firework light each is about 0.6 m to 1.8 m. Such a firework light is cumbersome for manufacturing as well as cost high, and the largest trouble of it is resided in the huge volume thereof and inconvenience of transportation and storage.

SUMMARY OF THE INVENTION

The object of the present invention is to provide a sticking-positioned firework light, in which a base seat can make positioning of a plurality of lamp strings provided in a plurality of transparent pipes imitating radiation lamp pipes; a main lamp pipe extends downwardly from the center of the base seat, the top end of the main lamp pipe is connected with a light flashing device in the center of the base seat. The conductors of the internal lamp strings in the radiation lamp pipes are extended each for an ample length to connect with the main lamp pipe and its lamp string. The radiation lamp pipes and the main lamp pipe are all made of elastomer of suitable softness, all the radiation lamp pipes can be pulled out of the base seat for positioning by providing their ample lengths to form an effect of a firework in cooperating with the soft and elastic main lamp pipe, additionally, the firework light can be packed up in a package of smaller volume in favor of transportation by manufacturers or storage by distributors or users.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
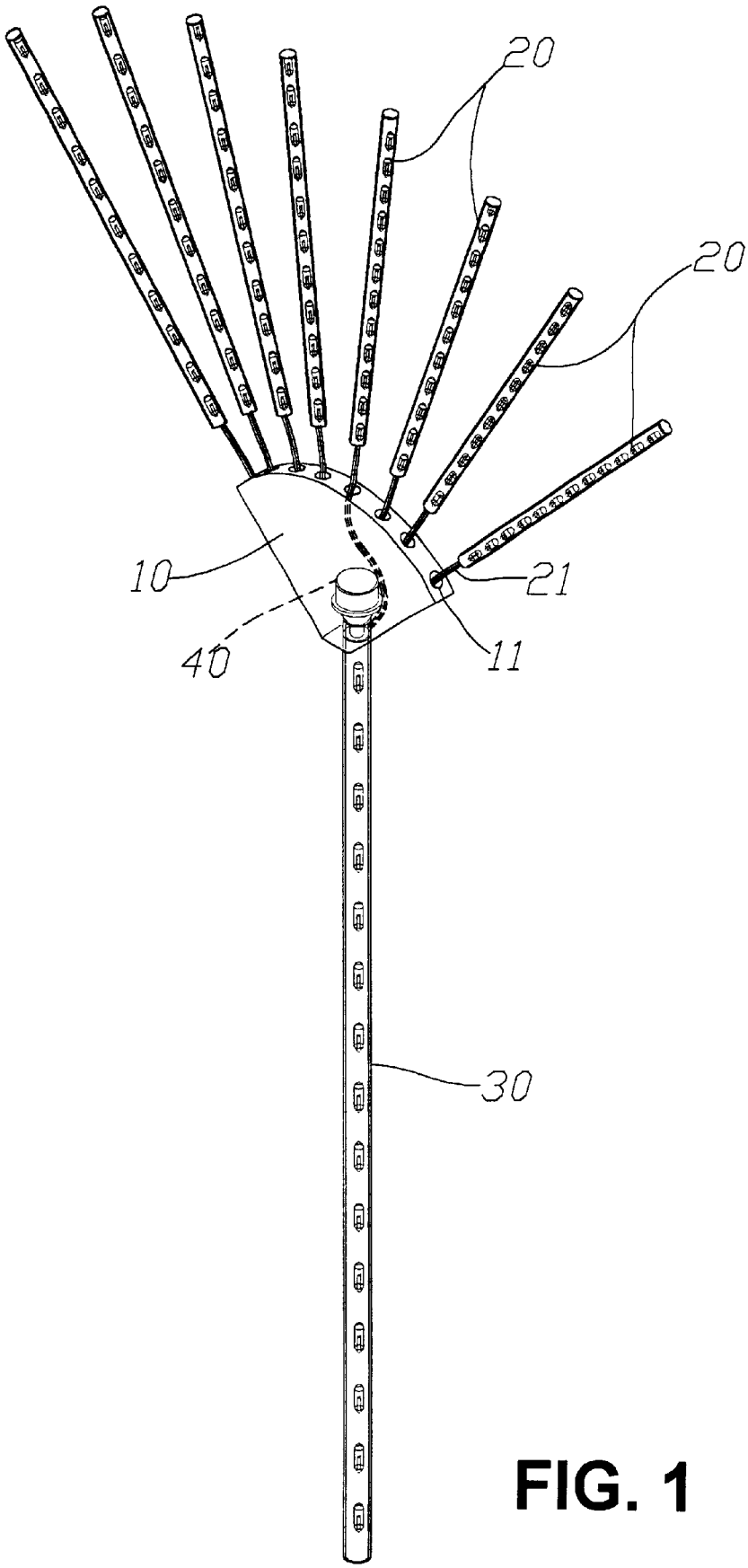
FIG. 1 is a perspective view of the radiation lamp pipes in a preferred embodiment of the present invention when in a non-positioned state.
Figure 2:
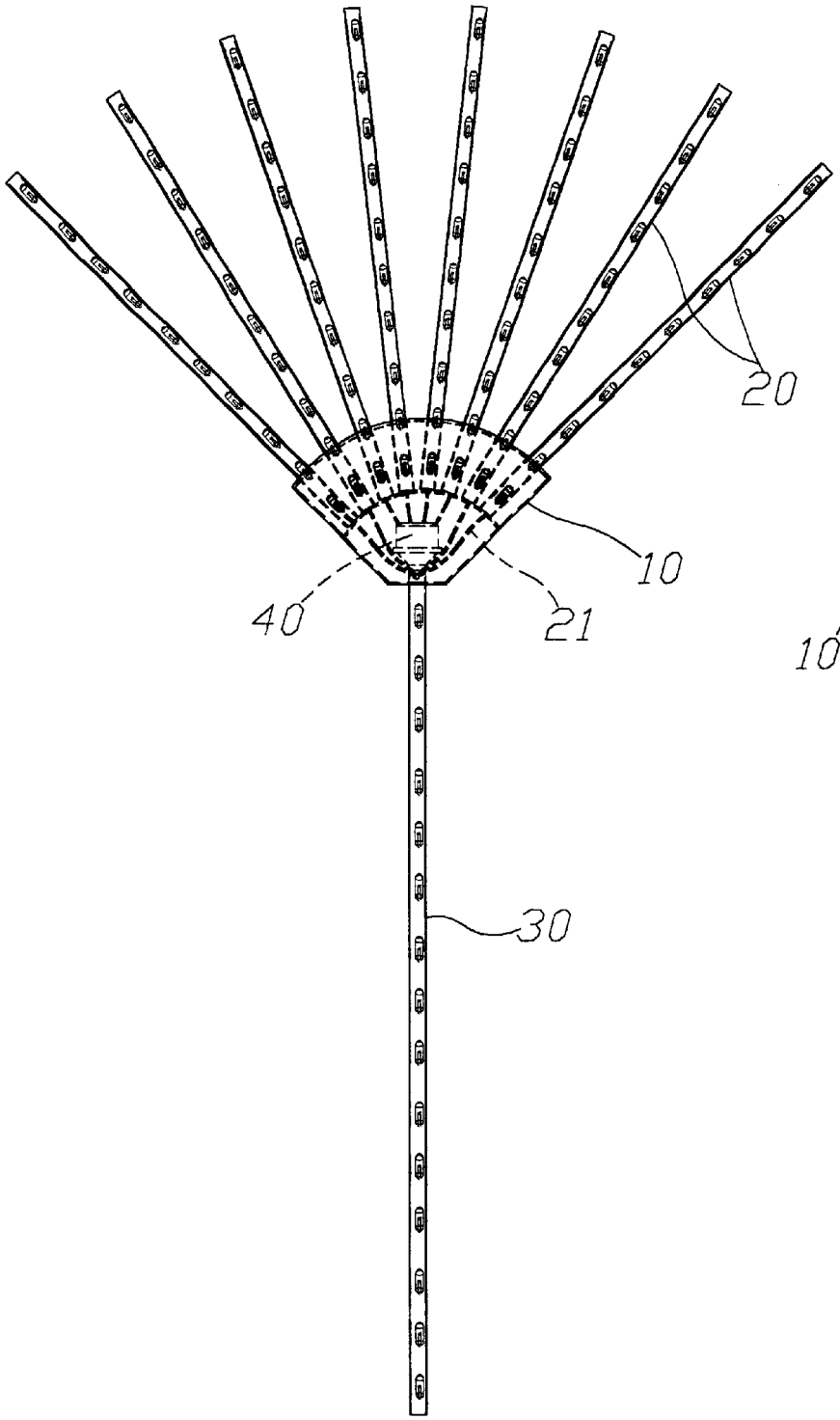
FIG. 2 is front view of taken from FIG. 1 with the radiation lamp pipes positioned.
Figure 3:
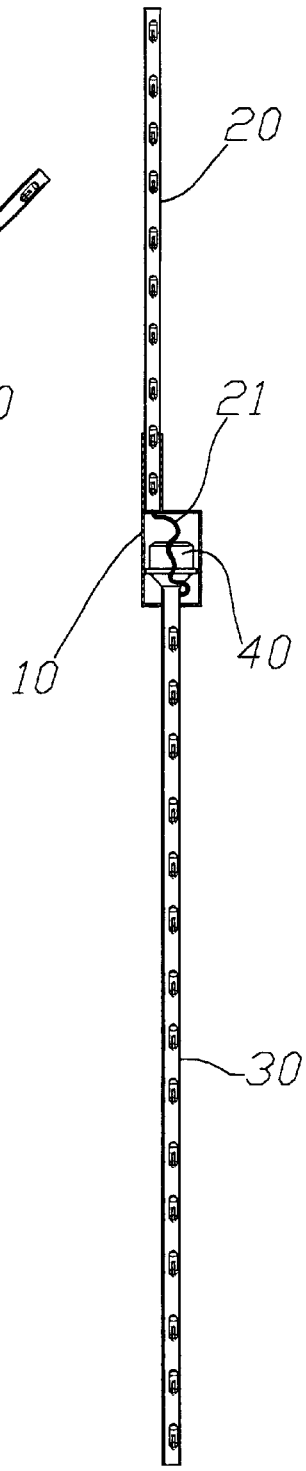
FIG. 3 is a side view taken from FIG. 2.

Referring to FIGS. 1–3, the sticking-positioned firework light of the present invention is comprised of a base seat 10, a plurality of transparent pipes 20 and a main lamp pipe 30. Wherein, the base seat 10 is made to render its thickness not overly large, the entire firework light can be mounted by sticking in a field to be decorated after being stretched and positioned.

In the preferred embodiment shown in FIG. 1, all the radiation lamp pipes 20 are pulled out to be in a non-positioned state, it is shown that a conductor 21 of every radiation lamp pipe 20 is pulled out of the base seat 10 from their corresponding positioning hole 11.

The transparent pipes 20 and the main lamp pipe 30 are all made of elastomer of suitable softness, that is, the lamp pipes 20 and 30 are not overly soft and can be given fixed shapes, but still can be bent for collection. All the lamp pipes 20 and 30 are provided internally with their own lamp strings that can be connected with a light control device (not shown) through their corresponding conductors, so that flashing time and modes of the lamp strings in the lamp pipes 20 and 30 can be controlled.

In the preferred embodiment shown, the base seat 10 is generally in the shape of a sector on which a plurality of positioning holes 11 are provided and spaced equally. Each lamp pipe 20 thereby can have its partial length on the bottom end thereof inserted into one of the positioning holes 11. The lamp pipes 20 can thereby be arranged in a radiation form on the base seat 10, and the conductors 21 of the radiation lamp pipes 20 are extended each for an ample length, so that after insertion of the lamp pipes 20, the conductors 21 are completely contracted into the base seat 10 (referring to FIG. 3). And when in collapsing the light, each lamp pipe 20 can be pulled out of its positioning hole 11 (referring to FIG. 1).

And in the preferred embodiment shown, a light flashing device 40 is provided between the top end of the main lamp pipe 30 and the bottom end of the radiation lamp pipes 20. With such a structure, a control device can make the lamp bulbs on the internal lamp string of the main lamp pipe 30 be lightened one by one gradually from the lowermost one upwardly, when this is proceeded to the light flashing device 40, flashing is put out for a period of time, then the internal lamp strings in the radiation lamp pipes 20 are lightened in various modes. This can make an effect of firework as if it were ejected to a high spot and then exploded to flash.

Figure 4:
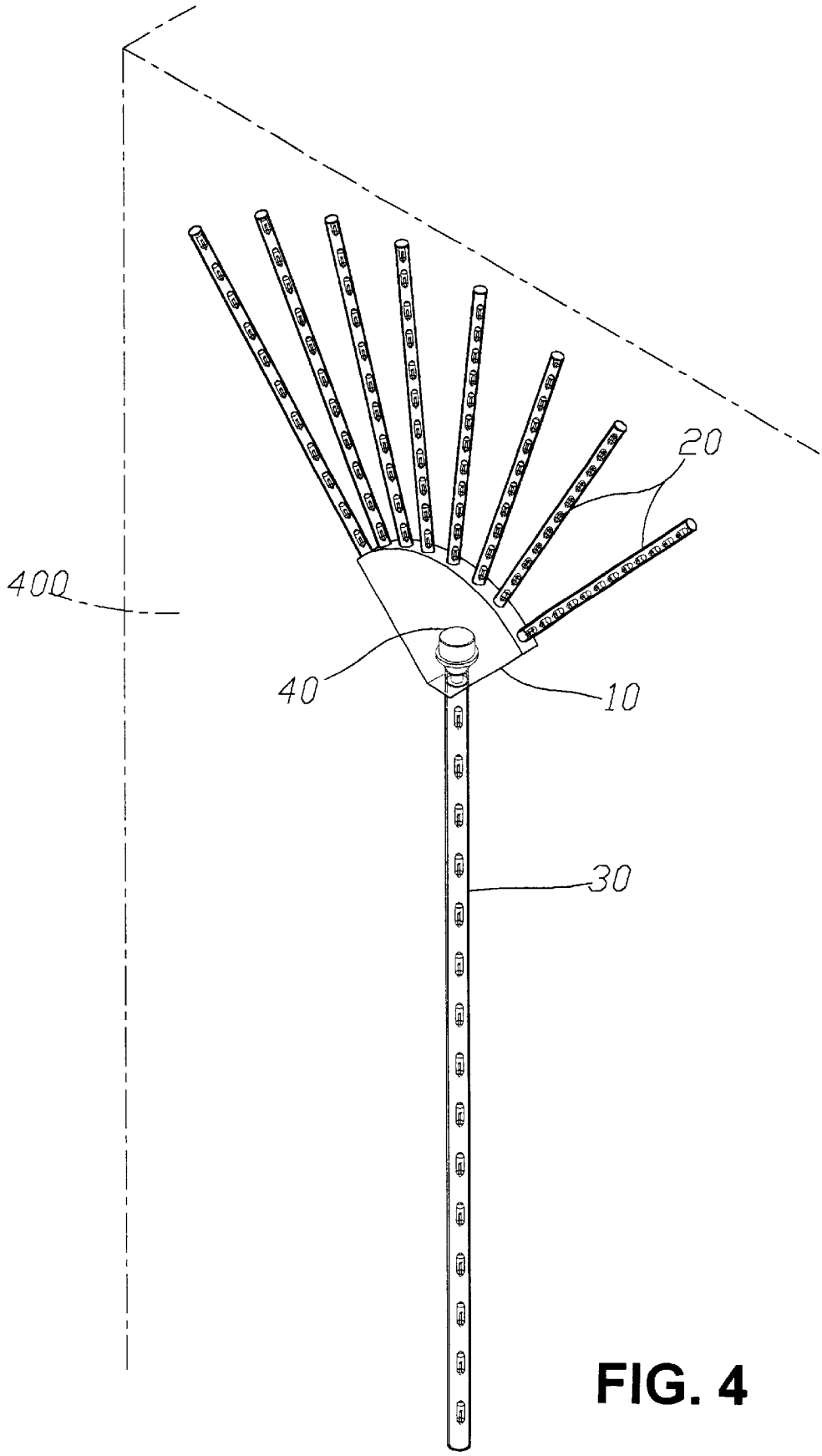
FIG. 4 is a schematic view showing the present invention is positioned on a wall by sticking.
Figure 5:
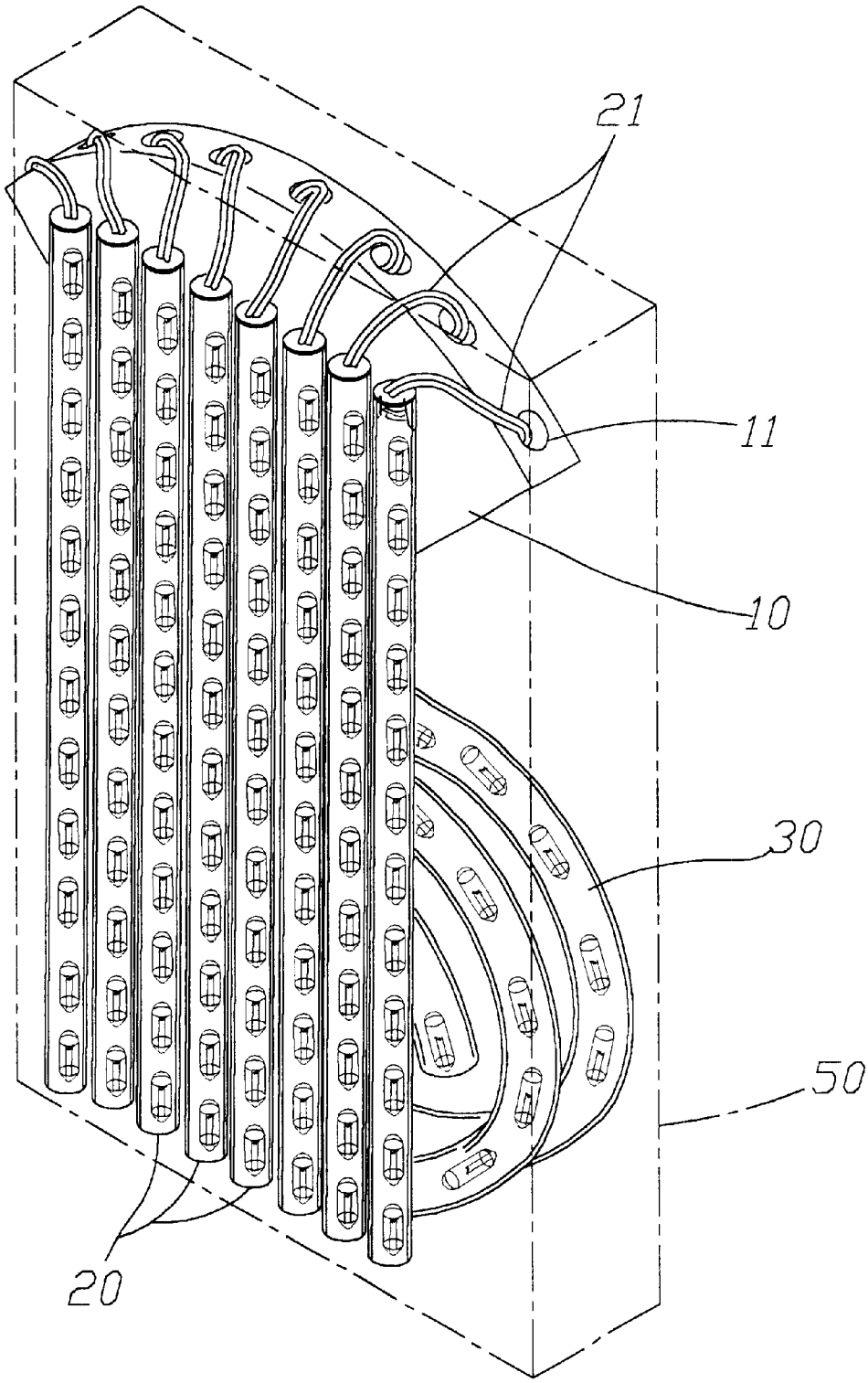
FIG. 5 is a schematic view showing the present invention is stored in a package.

The present invention hence can be mounted on a wall 400 by sticking as is depicted in FIG. 4 to get an effect of firework. Or as shown in FIG. 5, the present invention can be stored. When all the radiation lamp pipes 20 of the present invention are pulled out of their positioning holes 11, they can be folded and arranged tidily in a pending mode on the surface of the base seat 10, while the main lamp pipe 30 can be wrapped up into a ring form, and the entire firework light can be packed and stored in a packing container or box with a small volume in favor of transportation by manufacturers or storage by distributors, and users can also have it stored when not in use.

Figure 6:
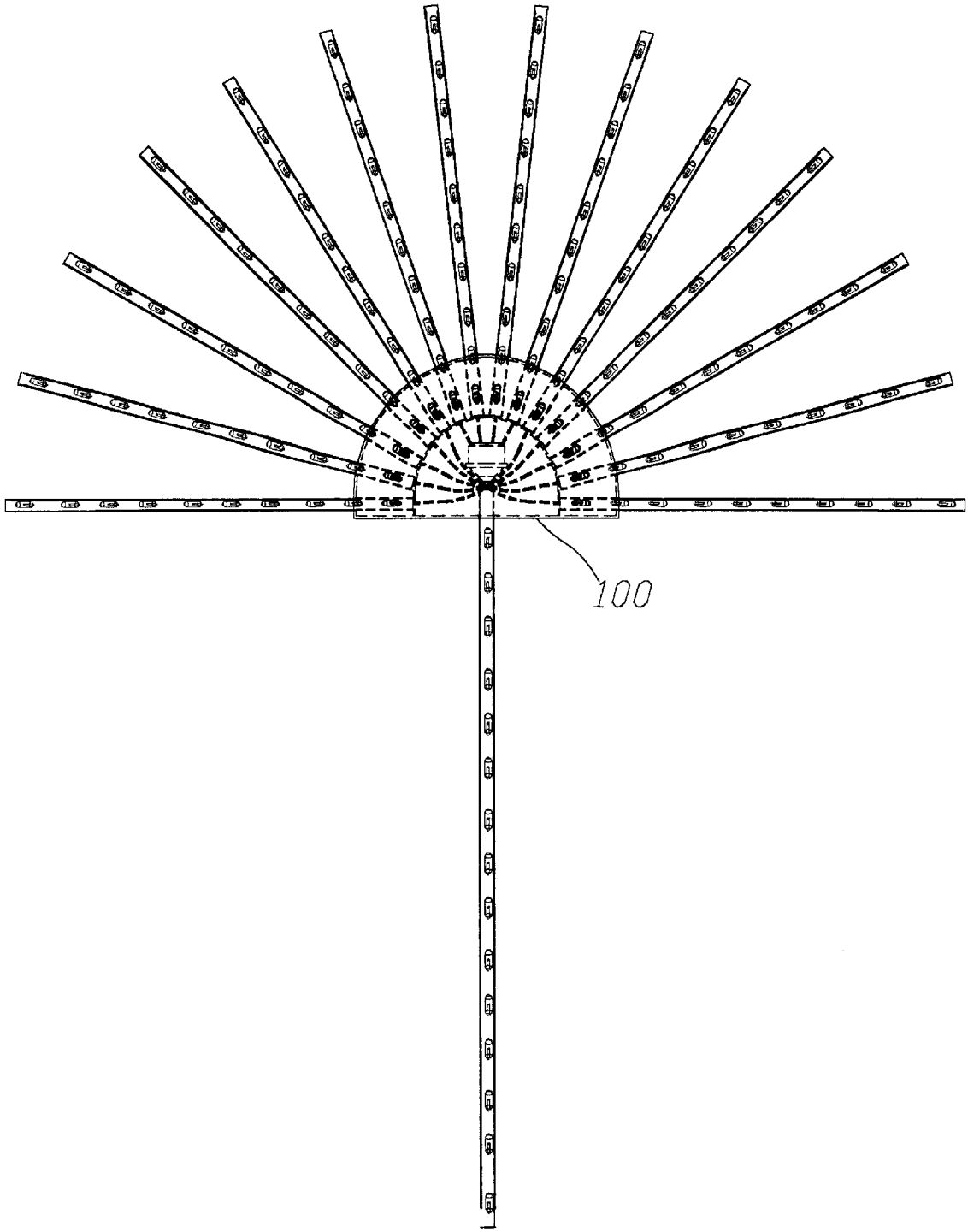
FIG. 6 is front view of another preferred embodiment of the present invention.

In the above embodiment of the present invention, the round positioning holes 11 are provided in corresponding to the round radiation lamp pipes 20, the base seat 10 and the radiation lamp pipes 20 can certainly be positioned and arranged in a spaced mode with some other structure without departing from the spirit and scope of the present invention. The base seat 10 in the shape of a sector can be substituted by a base seat 100 in the shape of a semicircle as shown in FIG. 6 to give a different visual effect of radiation.

The embodiment cited above is only for illustrating a preferred embodiment and not for giving any limitation to the scope of the present invention. It will be apparent to those skilled in this art that various modifications or changes without departing from the spirit and scope of the present invention can be made to and shall fall within the scope of the appended claims of the present invention.

What is claimed is:

1. A sticking-positioned firework light comprising:

a base seat;

a plurality of radiation lamp pipes positioned on a top of said base seat, each of the plurality of radiation lamp pipes having a conductor;

a main lamp pipe extending downwardly from the center of said base seat; said radiation lamp pipes and said main lamp pipe being all made of soft elastomer, and lamp strings being placed in said radiation lamp pipes and said main lamp, a plurality of corresponding positioning devices provided on the top of said base seat for inserting therein of said radiation lamp pipes; said conductors being extended each for an ample length when normally being inserted in said positioning devices to be contracted in said base seat.

2. The sticking-positioned firework light as claimed in claim 1, wherein, a light flashing device is provided in said base seat between the bottoms of said radiation lamp pipes and said main lamp pipe.

3. The sticking-positioned firework light as claimed in claim 1, wherein, said positioning devices comprise a plurality of positioning holes in correspondence in shape with said radiation lamp pipes.

4. The sticking-positioned firework light as claimed in claim 1, wherein, said base seat is in the shape of a sector.

5. The sticking-positioned firework light as claimed in claim 1, wherein, said base seat is in the shape of a semicircle.

* * * * *